US010823181B2

(12) United States Patent
Whittington

(10) Patent No.: US 10,823,181 B2
(45) Date of Patent: Nov. 3, 2020

(54) COMPACT FAN AND AIR CONDITIONER ASSEMBLY

(71) Applicant: Peter Charles Whittington, Oakland Park, FL (US)

(72) Inventor: Peter Charles Whittington, Oakland Park, FL (US)

( * ) Notice: Subject to any disclaimer, the term of this patent is extended or adjusted under 35 U.S.C. 154(b) by 97 days.

(21) Appl. No.: 16/150,692

(22) Filed: Oct. 3, 2018

(65) Prior Publication Data

US 2020/0109714 A1 Apr. 9, 2020

(51) Int. Cl.

| | |
|---|---|
| ***F04D 25/08*** | (2006.01) |
| ***F24F 1/0011*** | (2019.01) |
| ***F24F 1/022*** | (2019.01) |
| *F24F 1/0047* | (2019.01) |

(52) U.S. Cl.

CPC ..... *F04D 25/088* (2013.01); *F24F 1/0011* (2013.01); *F24F 1/022* (2013.01); *F24F 1/0047* (2019.02)

(58) Field of Classification Search

CPC ..... F04D 25/08; F04D 25/088; F24F 1/0011; F24F 1/0047; F24F 1/005; F24F 1/022; F24F 1/0317

See application file for complete search history.

(56) References Cited

U.S. PATENT DOCUMENTS

| | | | | |
|---|---|---|---|---|
| 4,586,349 | A | 5/1986 | Ohishi | |
| 5,029,451 | A | 7/1991 | Imaiida et al. | |
| 5,524,450 | A * | 6/1996 | Chen | F24F 1/0003 62/259.1 |
| 6,587,642 | B1 | 7/2003 | King | |
| 7,367,201 | B1 | 5/2008 | Doring et al. | |
| D741,469 | S | 10/2015 | Pan | |
| 9,683,752 | B2 | 6/2017 | Edwards et al. | |
| 2003/0228142 | A1 | 12/2003 | Reiker | |
| 2004/0149869 | A1 | 8/2004 | Chen | |
| 2007/0155304 | A1 | 7/2007 | Hyun et al. | |
| 2008/0213097 | A1 * | 9/2008 | Oleson | F04D 29/681 416/210 R |
| 2009/0208333 | A1 * | 8/2009 | Smith | F04D 25/068 416/5 |
| 2013/0219933 | A1 * | 8/2013 | Hubert | F04D 19/002 62/121 |
| 2019/0056128 | A1 * | 2/2019 | Jacob | B01D 53/265 |
| 2019/0277514 | A1 * | 9/2019 | Roy | F24F 1/029 |

FOREIGN PATENT DOCUMENTS

| | | | |
|---|---|---|---|
| CN | 206160344 | U | 5/2017 |
| WO | 2014156542 | A1 | 10/2014 |

* cited by examiner

*Primary Examiner* — Marc E Norman

(74) *Attorney, Agent, or Firm* — Laurence A. Greenberg; Werner H. Stemer; Ralph E. Locher

(57) ABSTRACT

A compact fan and air conditioner assembly includes an air conditioner configured to be mounted in a stationary manner below a ceiling of a room. The air conditioner produces a quantity of cold air. A fan receives all of the quantity of cold air from the air conditioner. The fan has a housing configured to be mounted in a stationary manner below the air conditioner and blades configured to rotate about the housing. The fan blades have channels receiving the cold air from the air conditioner and the fan blades have slots formed therein for receiving the cold air from the channels and distributing the cold air into the environment as the fan blades rotate. A split fan and air conditioner assembly includes a floor stand on which the air conditioner and the fan are mounted.

14 Claims, 3 Drawing Sheets

COMPACT FAN AND AIR CONDITIONER ASSEMBLY

BACKGROUND OF THE INVENTION

Field of the Invention

The invention relates to a compact fan and air conditioner assembly which enhances the cooling effect of a fan.

Description of the Related Art

U.S. Publication No. 2003/0228142 discloses a ceiling mounted heating and cooling device in which an air conditioning system is installed above a ceiling in an attic of a room and a fan is disposed below the ceiling and receives cold air from the air conditioning system. The device requires an attic and the installation of equipment in the attic. A portion of the cold air may be directed away from the fan blades.

U.S. Pat. No. 6,587,642 similarly provides an air conditioner condenser unit mounted above or beyond a ceiling of a room and an evaporator unit mounted inside or at the ceiling. The evaporator unit draws in hot room air, cools the air and blows the air toward a conventional, separate ceiling fan. A portion of the cold air may therefore be directed away from the fan blades.

U.S. Pat. No. 7,367,201 relates to an air conditioning fan in which an air conditioning unit, a fan having fan blades with evaporator tubing within the blades and a motor are all suspended from a ceiling of a room. The motor rotates the entire conditioning unit and the fan blades together. The fan blades are cooled by the evaporating moisture and the air in the room is impacted by the cooled fan blades. The motor must be large enough to rotate the relatively heavy air conditioning unit and the tubing within the fan blades does not carry cold air.

The prior art devices either mount all or part of the air conditioning unit at or above a ceiling or rotate the entire air conditioning unit with the fan blades. The prior art devices also do not supply all of the cold air from the air conditioning unit to the fan blades in manner which prevents leakage of cold air.

BRIEF SUMMARY OF THE INVENTION

It is accordingly an object of the invention to provide a compact fan and air conditioner assembly, which overcomes the hereinafore-mentioned disadvantages of the heretofore-known devices of this general type and which requires no installation above a ceiling, rotates only the fan blades and directs all of the cold air to and through the fan blades.

With the foregoing and other objects in view there is provided, in accordance with the invention, a compact fan and air conditioner assembly, comprising an air conditioner configured to be mounted in a stationary manner below a ceiling of a room, the air conditioner producing a quantity of cold air, and a fan receiving all of the quantity of cold air from the air conditioner, the fan having a housing configured to be mounted in a stationary manner below the air conditioner, and the fan having fan blades configured to rotate about the housing, the fan blades having channels receiving the cold air from the air conditioner, and the fan blades having slots formed therein for receiving the cold air from the channels and distributing the cold air into the environment in a room as the fan blades rotate.

The assembly according to the invention requires no installation above a ceiling, only the fan blades and not the air conditioner rotate and all of the cold air is directed to and through the fan blades so that no leakage reducing the cooling effect takes place.

In accordance with another feature of the invention, the air conditioner includes an evaporator coil, a blower fan blowing cold air through the evaporator coil, and an air ventilator chamber receiving the cold air from the evaporator coil and guiding the cold air into the channels in the fan blades. The channels in the blades therefore receive the cold, air conditioned air which would otherwise be directed to vents in a standard prior art air conditioner.

In accordance with another feature of the invention, the fan blades have ends, and each of the ends has two respective circular lobes having some of the slots formed therein for emitting the cold air to be circulated by the fan. It has been found that the use of multiple vents in circular lobes aids in the circulation of the cold air throughout the room.

In accordance with another feature of the invention, the blades each have a respective angled end for enhancing circulation of the cold air. The angled ends add more turbulence to the air in the room which in turn spreads the cold air in the room.

In accordance with another feature of the invention, the air conditioner includes condenser, a vent attached to the housing, and a blower fan blowing hot air through the condenser and out of the housing into the vent. The hot air is thus carried away from the space to be cooled, for instance to the outside of a building.

In accordance with another feature of the invention, the air conditioner includes a water pump for removing condensate from the housing. This feature ensures that no water will drip from the assembly.

With the objects of the invention in view, there is also provided a split fan and air conditioner assembly, comprising a floor stand, an air conditioner mounted on the floor stand, the air conditioner producing a quantity of cold air, and a fan mounted on the floor stand, the fan receiving all of the quantity of cold air from the air conditioner, the fan having a housing, and the fan having fan blades configured to rotate about the housing, the fan blades having channels receiving the cold air from the air conditioner, and the fan blades having slots formed therein for receiving the cold air from the channels and distributing the cold air into the environment in a room as the fan blades rotate.

In accordance with another feature of the invention, the floor stand includes a base and a telescoping pole mounted on the base. The height of the assembly can therefore be adjusted, in a manner similar to a fan standing on a base.

In accordance with another feature of the invention, a vent line receives hot air from the air conditioner. Thus, in this embodiment as well, the hot air is carried away from the space to be cooled, for instance to the outside of a building.

In accordance with another feature of the invention, a cold air line guiding the cold air from the air conditioner to the fan. Due to the cold air line, the fan can be placed at a distance from the air conditioner which is limited only by the length of the line.

In accordance with a concomitant feature of the invention, the air conditioner has a housing with an access door. In this way, a pan collecting condensate water can be emptied or a filter can be changed.

Other features which are considered as characteristic for the invention are set forth in the appended claims.

Although the invention is illustrated and described herein as embodied in a compact fan and air conditioner assembly, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DETAILED DESCRIPTION OF THE INVENTION

Figure 1:
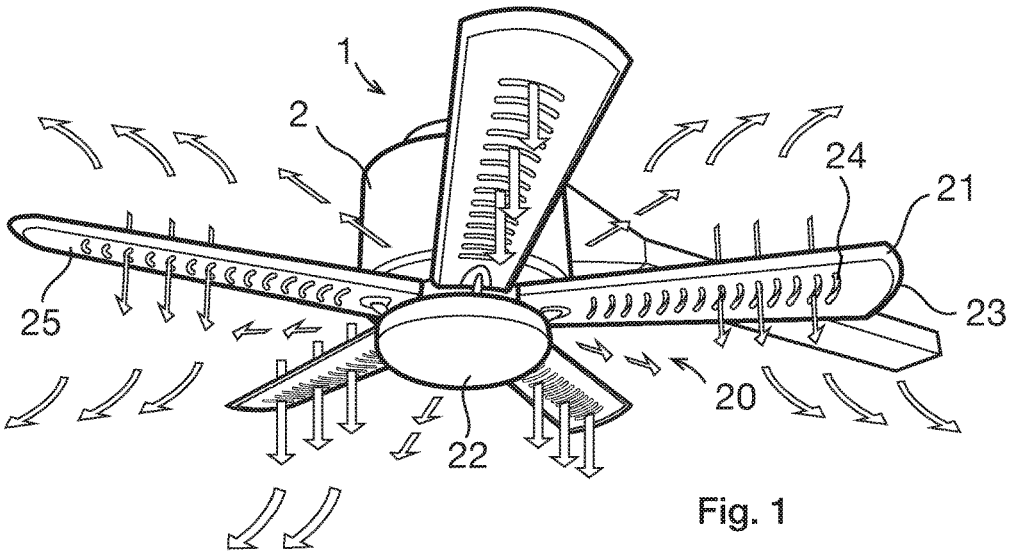
FIG. 1 is a diagrammatic, perspective view of a first embodiment of the compact fan and air conditioner assembly according to the invention having planar fan blades.
Figure 2:
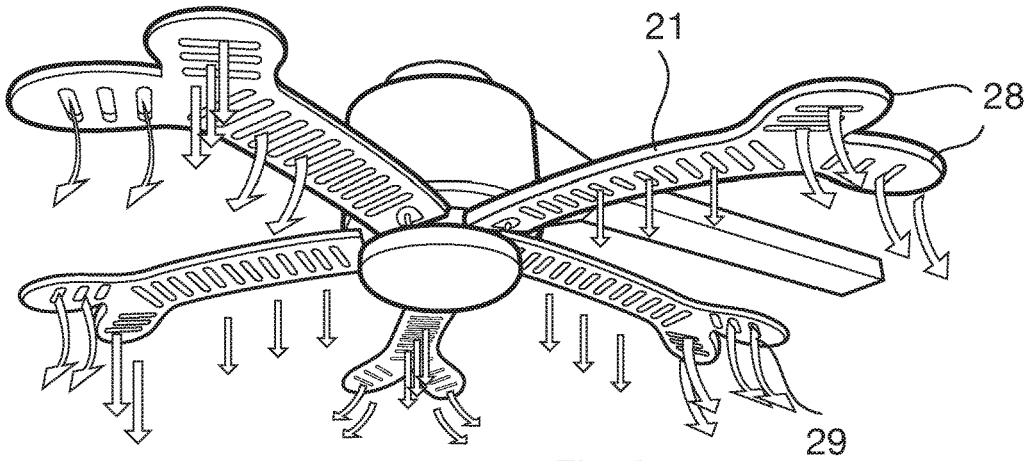
FIG. 2 is a perspective view of the first embodiment of the assembly having lobes on the ends of the fan blades.
Figure 3:
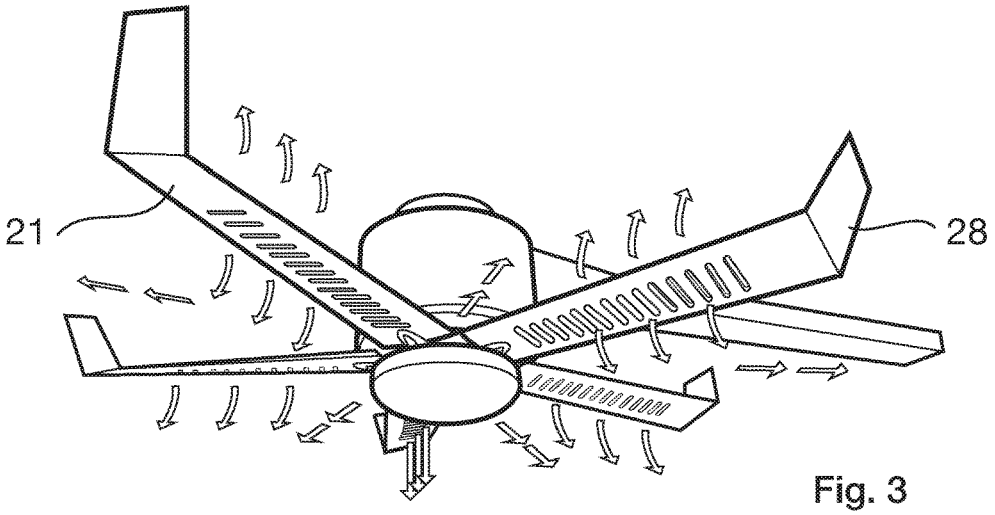
FIG. 3 is a perspective view of the first embodiment of the assembly having angled ends of the fan blades.

Referring now to the figures of the drawing in detail and first, particularly, to FIG. 1 thereof, there is seen an assembly in which an air conditioner 1 is disposed above a fan 20. The air conditioner 1 has a housing 2 containing components of the air conditioner, which are described in detail below. The air conditioner 1 blows cold air downwards into fan blades 21 of the fan 20. A light 22 is fastened below a hub connected to the fan blades. The fan blades 21 have curved ends 23 and internal channels 26 (see FIG. 4) which conduct the cold air through elongated slots 24 in the lower surfaces 25 of the blades. The cold air is circulated by the movement of the blades in the direction of the arrows. FIG. 2 shows that the ends 23 of the blades 21 each have two circular lobes 28 which also have slots 29 for emitting the cold air to be circulated by the fan. The blades may each alternatively have one or more than two lobes. According to FIG. 3, the blades 21 each have an angled end 28 which adds to the circulation of the cold air.

Figure 4:
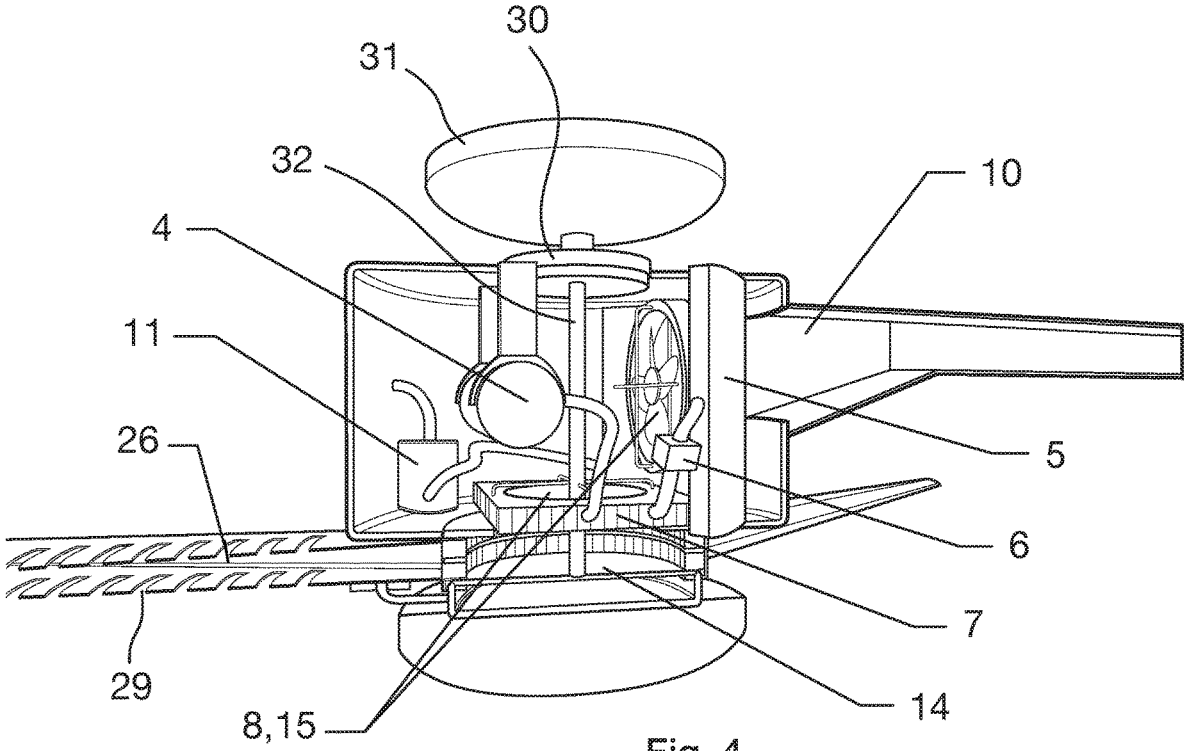
FIG. 4 is an enlarged, fragmentary view of the body of the fan showing internal details.
Figure 5:
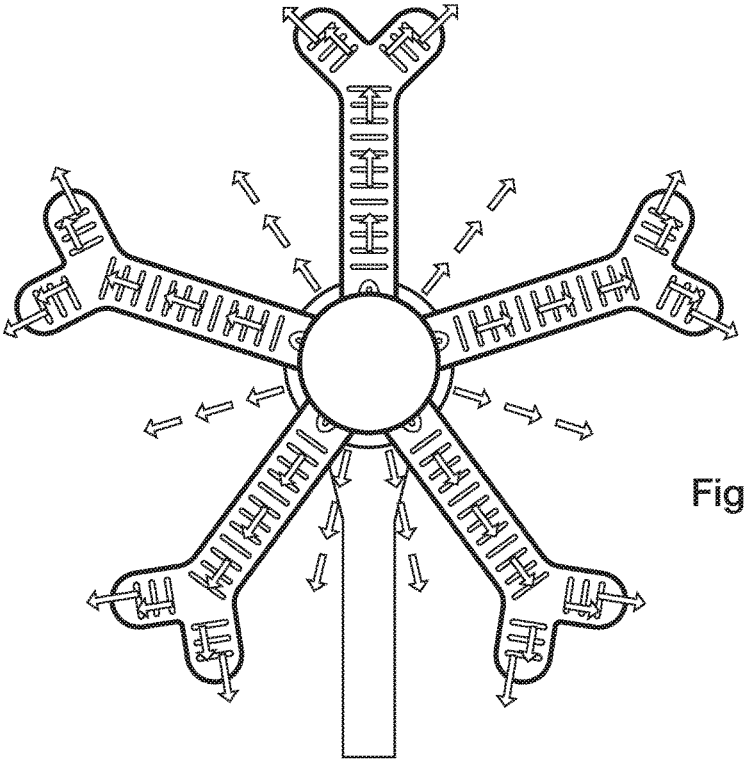
FIG. 5 is a bottom-plan view of the assembly of FIG. 2.

The housing 2 of the air conditioner 1 shown in FIG. 4 contains a compressor 4, a condenser 5, an expansion valve 6 and a evaporator coil 7 in an air conditioning circuit. A first blower fan 8 blows hot air through the condenser 5 and out of the housing 2 into a vent 10. A water pump 11 pumps condensate out of the housing 2. A second blower fan 15 blows cold air through the evaporator coil into an air ventilator chamber 14 which guides the cold air into channels 26 in the fan blades 21 leading to the slots 29. The cold air can also be guided through the air ventilator chamber 14 and the channels 26 without the use of the blower fan 15 due to the differential pressure created by the rotating blades. In this regard, FIG. 5 shows the assembly of FIG. 2 from below in order to indicate the movement of the cold air along the arrows. A fan motor 30 is supported on a ceiling by a bracket disposed within a cover 31. The fan motor 30 drives the fan blades 21 through a shaft 32. The connection between the shaft and the blades is not illustrated for the sake of clarity.

Figure 6:
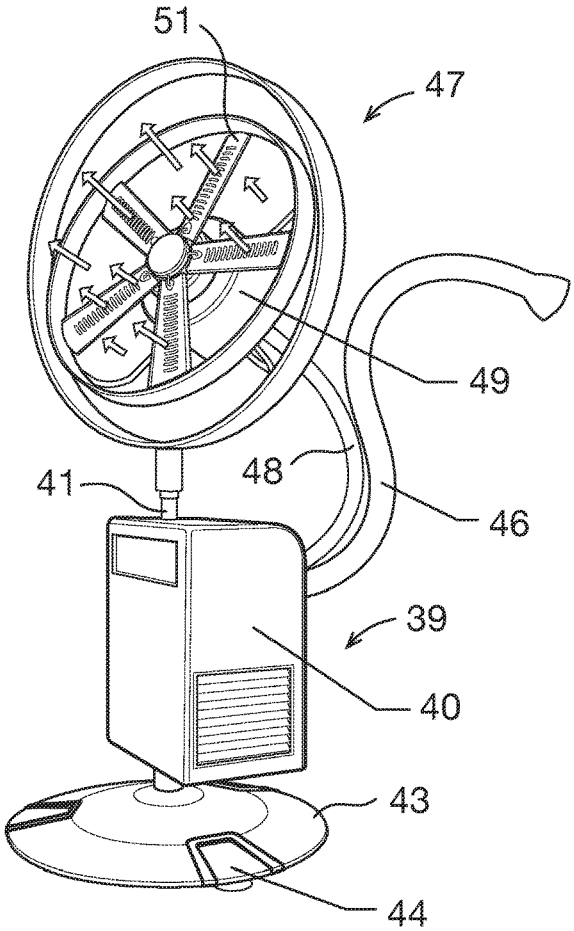
FIG. 6 is a front-perspective view of a second embodiment of the assembly constructed as a split system.
Figure 7:
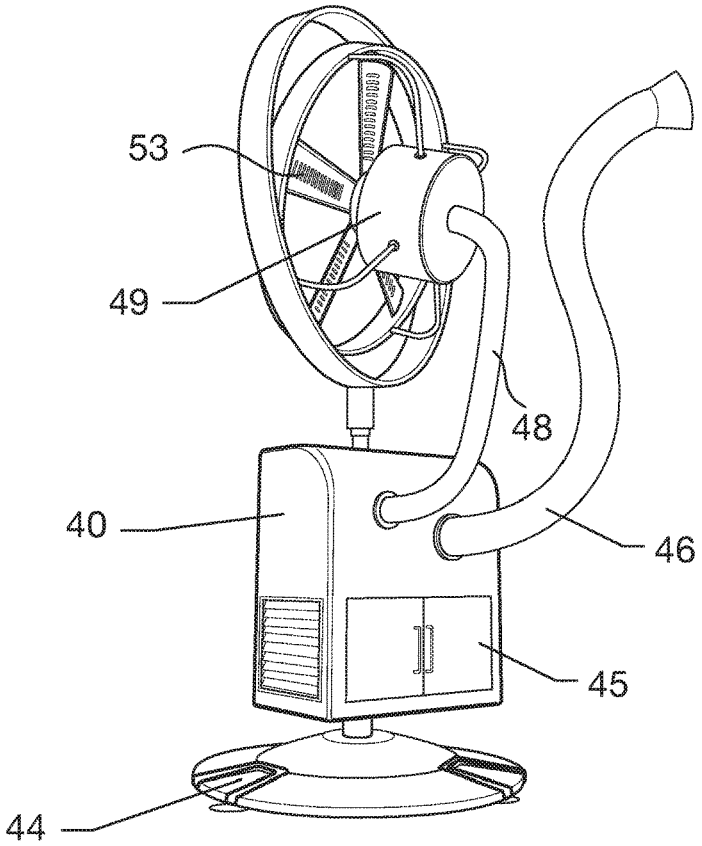
FIG. 7 is a rear-perspective view of the second embodiment of the assembly shown in FIG. 6.

The second embodiment of the assembly shown in FIGS. 6 and 7 is a split system in which an air conditioner 39 has a housing 40 containing a compressor, a condenser, an expansion valve and a evaporator coil in an air conditioning circuit, as well as two blowers, as is shown in FIG. 4. The housing 40 is supported by a telescoping pole 41 mounted on a base 43 having suction activated pedals 44 for gripping the floor. The telescoping pole 41 and the base 43 together may be referred to as a floor stand. A rear door 45 provides access to a non-illustrated tray for receiving condensate and to a non-illustrated filter.

A vent line 46 receives hot air blown through the condenser from the first blower fan. A cold air line 48 receives cold air blown by the second blower through the evaporator coil. The cold air line 48 leads to a fan 47 having a fan housing 49 containing a motor for turning fan blades 51 and an air ventilation chamber guiding the cold air from the cold air line 48 to the fan blades. The fan blades have channels receiving the cold air from the cold air line 48 and guiding the cold air to slots 53 in the fan blades which emit the cold air in the direction of the arrows. The fan blades may have the lobes of FIG. 2 or the angled ends of FIG. 3.

The invention claimed is:

1. A compact fan and air conditioner assembly, comprising:

an air conditioner completely enclosed within an air conditioner housing configured to be mounted in a stationary manner below a ceiling of a room, said air conditioner producing a quantity of cold air; and a fan receiving all of said quantity of cold air from said air conditioner, said fan being mounted in a stationary manner below said air conditioner, and said fan having fan blades configured to rotate about said air conditioner housing;

said fan blades having channels receiving the cold air from said air conditioner, said fan blades having slots formed therein for receiving the cold air from said channels and distributing the cold air into the environment as said fan blades rotate, said fan blades having ends, and each of said ends having two respective circular lobes having some of said slots formed therein for emitting the cold air to be circulated by said fan.

2. The assembly according to claim 1, wherein said fan blades each have a respective upper surface and said fan blades each have a respective end angled upward from said respective upper surface for enhancing circulation of the cold air.

3. The assembly according to claim 2, wherein each respective upwardly angled end has two mutually parallel planar surfaces.

4. The assembly according to claim 1, wherein said air conditioner includes an evaporator coil disposed in said air conditioner housing and a blower fan disposed in said air conditioner housing and blowing cold air through said evaporator coil, and said fan includes an air ventilator chamber receiving the cold air from said evaporator coil and guiding the cold air into said channels in said fan blades.

5. The assembly according to claim 3, wherein said air conditioner includes a condenser disposed in said air conditioner housing, a vent attached to said air conditioner housing, and a blower fan disposed in said air conditioner housing and blowing hot air through said condenser and out of said air conditioner housing into said vent.

6. The assembly according to claim 3, wherein said air conditioner includes a water pump disposed in said air conditioner housing for removing condensate from said air conditioner housing.

7. The assembly according to claim 3, wherein said two circular lobes of each respective fan blade have mutually parallel upper planar surfaces and mutually parallel lower planar surfaces.

8. A split fan and air conditioner assembly, comprising:

a floor stand including a base and a pole mounted on said base;

an air conditioner mounted on said pole and spaced apart from said base, said air conditioner producing a quantity of cold air; and a fan mounted on said floor stand, said fan receiving all of said quantity of cold air from said air conditioner, said fan having a housing, and said fan having fan blades configured to rotate about said housing;

said fan blades having channels receiving the cold air from said air conditioner, and said fan blades having slots formed therein for receiving the cold air from said channels and distributing the cold air into the environment as said fan blades rotate.

9. The assembly according to claim 8, wherein said pole is a telescoping pole.

10. The assembly according to claim 8, wherein said fan blades have ends, and each of said ends has two respective circular lobes having some of said slots formed therein for emitting the cold air to be circulated by said fan.

11. The assembly according to claim 8, wherein said blades each have a respective angled end for enhancing circulation of the cold air.

12. The assembly according to claim 8, which further comprises a vent line receiving hot air from said air conditioner.

13. The assembly according to claim 8, which further comprises a cold air line guiding the cold air from said air conditioner to said fan.

14. The assembly according to claim 8, wherein said air conditioner has a housing with an access door.

* * * * *